US007597392B1

(12) United States Patent
Gilmore

(10) Patent No.: US 7,597,392 B1
(45) Date of Patent: Oct. 6, 2009

(54) MULTI-FUNCTION MOBILE STOOL

(76) Inventor: Thorton Gilmore, 4858 Carnegie La., Brentwood, CA (US) 94513

( * ) Notice: Subject to any disclaimer, the term of this patent is extended or adjusted under 35 U.S.C. 154(b) by 0 days.

(21) Appl. No.: 12/177,710

(22) Filed: Jul. 22, 2008

(51) Int. Cl.
*A47C 7/62* (2006.01)

(52) U.S. Cl. ..... 297/217.1; 297/188.21; 297/461; 280/47.35; 280/79.5

(58) Field of Classification Search ..... 297/136, 297/177, 182, 188.09, 188.21, 217.1, 423.41, 297/461; 280/47.35, 47.38, 47.41, 79.2, 280/79.5
See application file for complete search history.

(56) References Cited

U.S. PATENT DOCUMENTS 1,652,792 A * 12/1927 Nagy ..... 312/231
4,242,971 A * 1/1981 Kleinman ..... 108/26
4,760,802 A * 8/1988 Leong ..... 248/188.1
4,950,033 A * 8/1990 Anderson ..... 297/461
5,112,103 A * 5/1992 Downer ..... 297/270.1
5,294,196 A 3/1994 Chen
5,611,551 A 3/1997 Lin
D399,626 S 10/1998 Taylor
6,209,891 B1 * 4/2001 Herrmann ..... 280/32.6
D466,668 S 12/2002 Peschmann
6,488,346 B2 12/2002 Chen
6,702,065 B2 * 3/2004 Ehnes ..... 280/30
6,733,073 B2 * 5/2004 Whiteside et al. ..... 297/188.08
6,857,644 B2 2/2005 Hsiao
7,237,781 B2 7/2007 Canova
7,273,215 B1 9/2007 Smith
7,427,076 B2 * 9/2008 Gwin ..... 280/79.2
2008/0136132 A1 * 6/2008 Brager ..... 280/47.35

* cited by examiner

*Primary Examiner*—Peter R. Brown
(74) *Attorney, Agent, or Firm*—Kyle Fletcher

(57) ABSTRACT

The invention is a multi-function mobile stool that attaches includes a bucket with a seat attached via a lanyard. The invention includes a wheeled base that includes a rotating storage container that surrounds the location where the bucket is situated upon the base. The bucket may be removed and carried off via a handle. The cushion may be removed from the top of the bucket and allowed to dangle to the side via the lanyard.

11 Claims, 4 Drawing Sheets

MULTI-FUNCTION MOBILE STOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of mobile stools, more specifically, a mobile stool with multiple functions.

For as long as stools have been around, there has been a need to make a stool mobile, and to include a plurality of storage compartments. The present invention is an improvement over the classic stool with storage compartment sin that it provides a rotating storage container that is circumferentially aligned with the stool.

B. Discussion of the Prior Art

As a preliminary note, it should be stated that there is an ample amount of prior art that deals with multi-functioning stools. As will be discussed immediately below, no prior art discloses a multi-function mobile stool that includes a removable bucket along with a rotating storage container.

The Lin Patent (U.S. Pat. No. 5,611,551) discloses a collapsible working chair that has a stool storage compartment and rolling wheels. However, the working chair does not include a removable bucket that acts as the base of which the seat is attached via a lanyard in order to access the interior of said bucket. Furthermore, the working chair does not include a rotating storage container such that when an end user is sitting on the stool he or she may rotate the storage container about the bucket in order to access all of the containers therein.

The Hsiao Patent (U.S. Pat. No. 6,857,644) discloses a tool box that has an integral seat and wheels. However, the tool box does not resemble a bucket that includes a seat attaché via a lanyard, and of which the tool box does not contain a rotating storage container.

The Chen Patent (U.S. Pat. No. 6,488,346) discloses a box for tools that has wheels and a seat. However, the seat does not resemble a bucket with a seat attached via a lanyard. Nor does the box have a rotating storage compartment about the wheeled base.

The Chen Patent (U.S. Pat. No. 5,294,196) discloses a tool cabinet that includes a bottom wall with a plurality of casters and a seat arrangement. Again, the seat does not resemble a bucket with a seat top attached via lanyard.

The Smith Patent (U.S. Pat. No. 7,273,215) discloses a tool creeper that has wheels and a storage area. However, the storage area does not rotate about the seat, which is also removable and usable as a bucket.

The Canova Patent (U.S. Pat. No. 7,237,781) discloses a mechanic's seat that has a tool holding area, a seat, and wheels. Again, the tool holding area does not rotate about the seat, which rests upon a removable bucket.

While the above-described devices fulfill their respective and particular objects and requirements, they do not describe a multi-function mobile stool that provides for the advantages of the multi-function mobile stool. In this regard, the multi-function mobile stool departs from the conventional concepts and designs of the prior art.

Therefore, a need exists for an multi-function mobile stool.

SUMMARY OF THE INVENTION

The invention is a multi-function mobile stool that attaches includes a bucket with a seat attached via a lanyard. The invention includes a wheeled base that includes a rotating storage container that surrounds the location where the bucket is situated upon the base. The bucket may be removed and carried off via a handle. The cushion may be removed from the top of the bucket and allowed to dangle to the side via the lanyard. The wheeled base shall include a plurality of caster wheels, one or more of which may have a locking mechanism such that will enable the invention to remain stationary.

It is a principle object of the present invention to provide a mobile stool with a plurality of storage compartments.

It is a further object of the invention to provide a mobile stool with a wheeled base containing a rotating storage container that rotates about the base of the stool.

It is a further object of the invention to provide a removable bucket that forms the base of the stool, and of which is attached to the seat via the lanyard.

It is a further object of the invention to provide a mobile stool that is lightweight, durable, and affordable.

These together with additional objects, features and advantages of the multi-function mobile stool will be readily apparent to those of ordinary skill in the art upon reading the following detailed description of presently preferred, but nonetheless illustrative, embodiments of the multi-function mobile stool when taken in conjunction with the accompanying drawings.

In this respect, before explaining the current embodiments of the multi-function mobile stool, it is to be understood that the multi-function mobile stool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the multi-function mobile stool. It is therefore important that the claims be regarded as including such equivalent construction insofar as they do not depart from the spirit and scope of the multi-function mobile stool. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
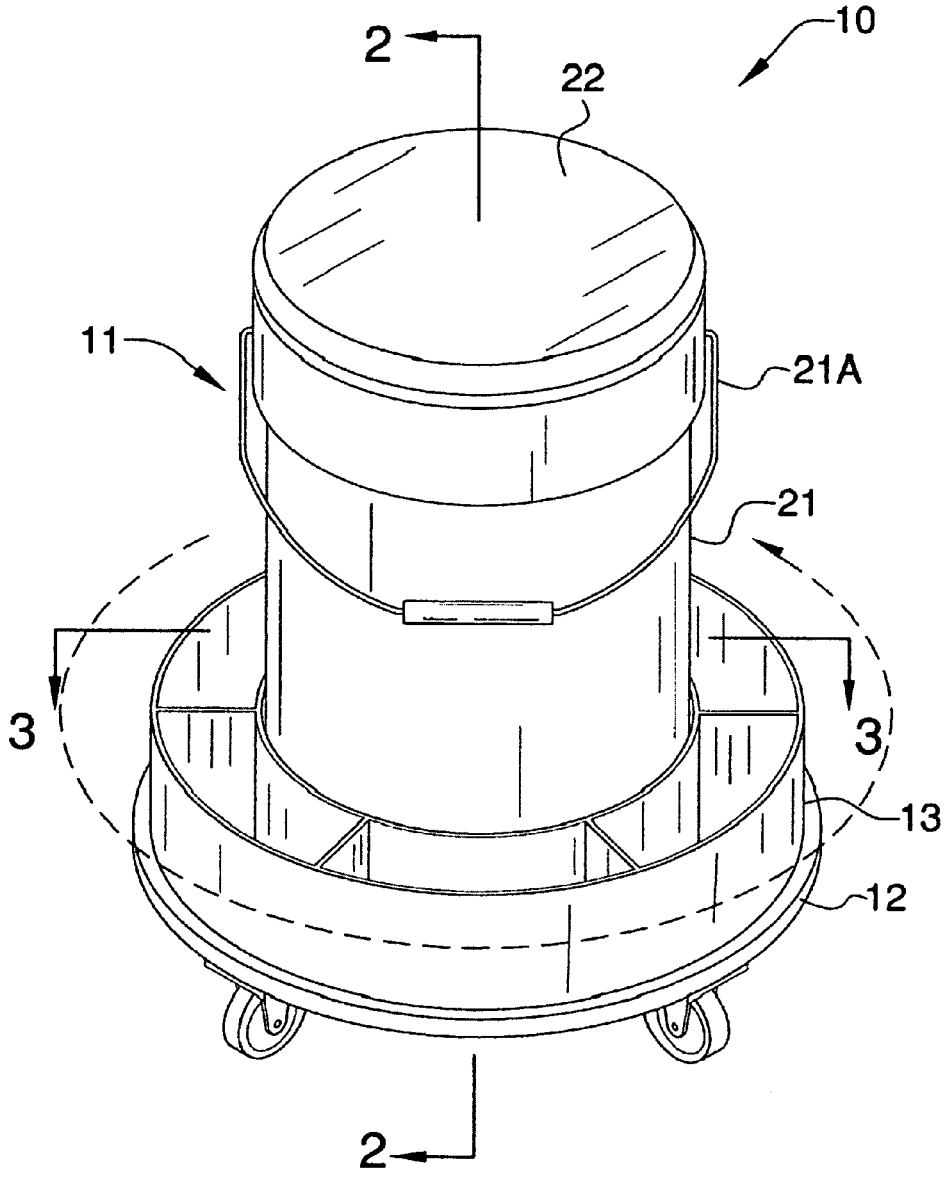
FIG. 1 illustrates an isometric view of the invention.
Figure 2:
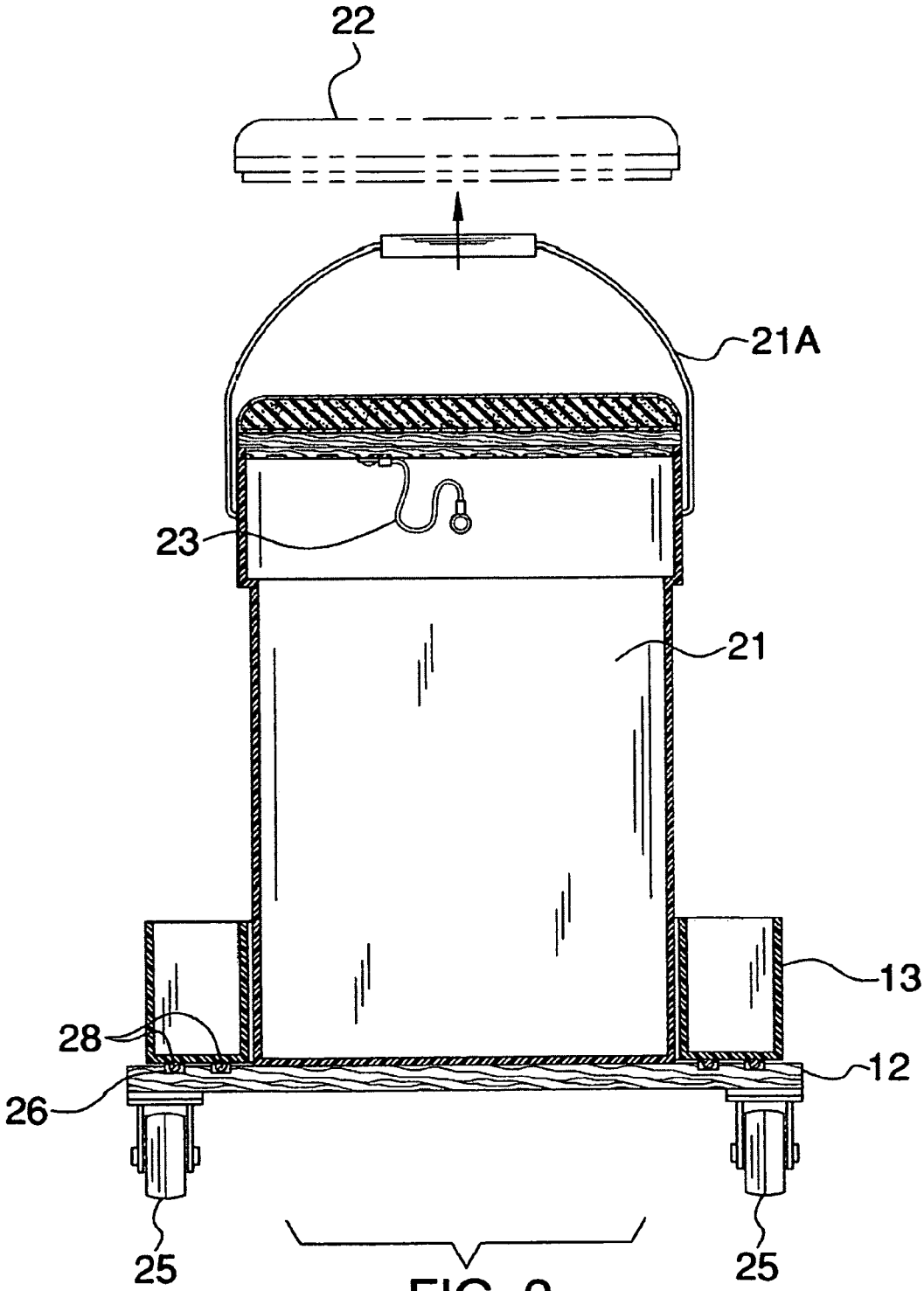
FIG. 2 illustrates a cross-sectional view of the invention along line 2-2 in FIG. 1.
Figure 3:
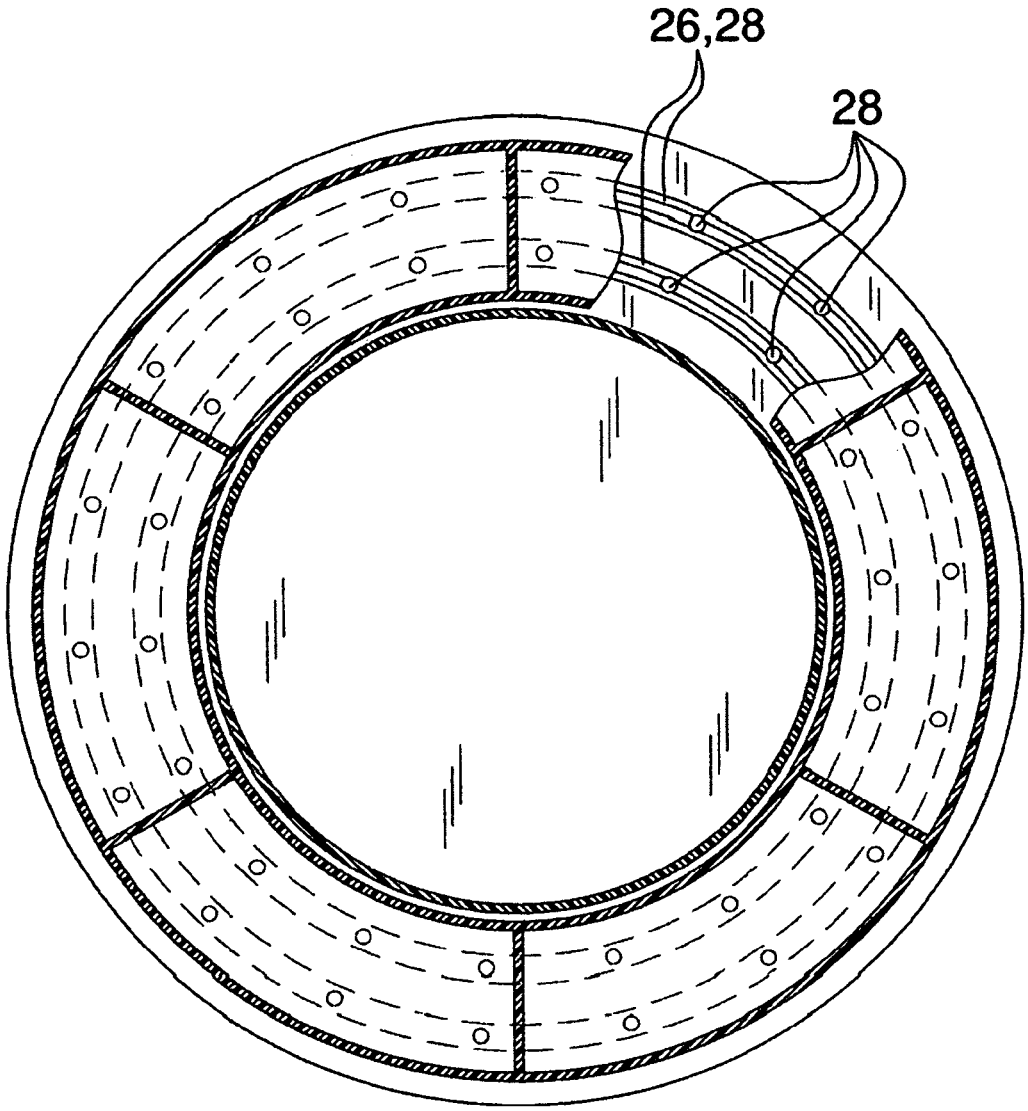
FIG. 3 illustrates a cross-sectional view of the rotating storage container along line 3-3 in FIG. 1.
Figure 4:
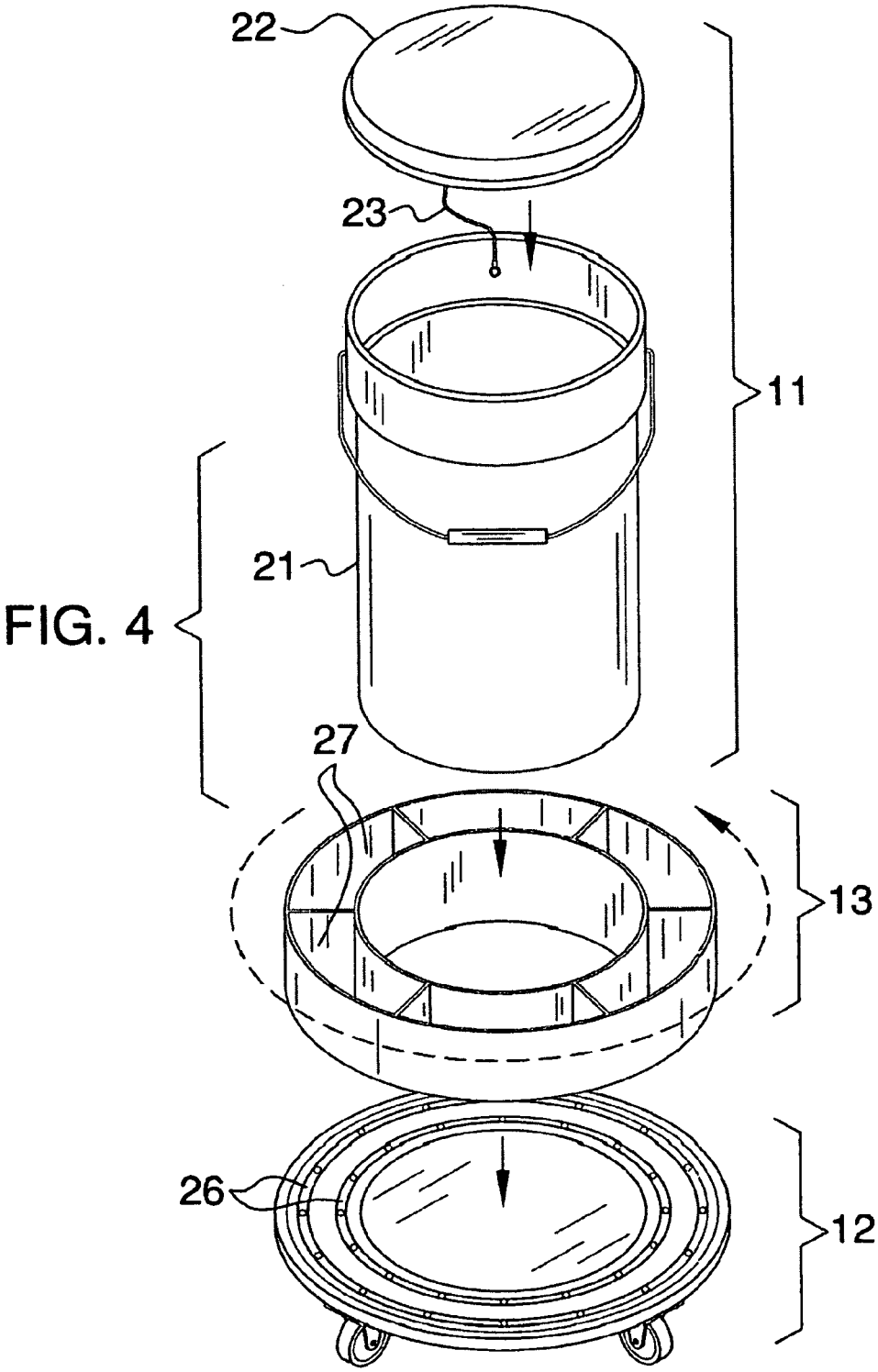
FIG. 4 illustrates an exploded view of the seat, bucket, rotating storage container, and wheeled base of the invention.

Detailed reference will now be made to the preferred embodiment of the present invention, examples of which are illustrated in FIGS. 1-4. A multi-function mobile stool 10 (hereinafter invention) includes a stool 11, a base 12, and a rotating storage compartment 13.

The stool 11 comprises a bucket 21 with a handle 21A, seat 22, and lanyard 23. The seat 22 is capable of resting along the top of the bucket 21 when in use, but is also capable of removal wherein said seat 22 will dangle to a side of the bucket 21 via the lanyard 23. It is important to note that the inclusion of the lanyard 23 will prevent the unintended loss of the seat 22.

The seat 22 is made of a material comprising a wood, a metal, a rubber, a plastic, or a sturdy base having a soft foam along the top surface.

The base 12 includes a plurality of caster wheels 24 that are mounted along the bottom surface of the base 12. One of the caster wheels 25 may feature a locking mechanism (not depicted), which is well known in the art. Located along the top surface of the base 12 are one or more roller grooves 26, which will be explained in more detail below.

The rotating storage compartment 13 will feature a plurality of storage compartments 27. The bottom surface of the rotating storage compartment 13 features one or more roller grooves 28. The roller grooves 26 and 28 are used in conjunction with a plurality of roller balls 29 in order to provide a rotating means. The roller grooves 26 and 28, used in conjunction with the roller balls 29 will provide the rotating storage compartment 13 with the rotating means necessary to rotate about the base 12.

It shall be noted that the ability to of the rotating storage compartment 13 to rotate about the base 12 is an important feature of the invention 10 as a whole. The ability of the rotating storage compartment 13 to rotate about the base 12 will enable an end user to rotate said storage compartment 13 while being seated on the stool 11.

The bucket 21, the base 12, and the rotating storage compartment 13 are made of a material comprising a metal, wood, or plastic.

Not depicted in FIGS. 1-4, the storage compartments 27 of the rotating storage compartment 13 may be equipped with a sealable enclosure that will enable the contents stored within to be sealed.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A multi-function mobile stool comprising:

(a) a stool;

(b) a base;

wherein the bottom of the base has a plurality of caster wheels;

wherein the stool attaches to the base;

(c) a rotating storage container;

wherein the rotating storage container rests upon the base;

wherein the rotating storage container rotates with respect to the base via a rotating means;

wherein the rotating storage container rotates around where the stool attaches to the base;

wherein the rotating storage container has a plurality of storage compartments.

2. The multi-function mobile stool as described in claim 1 wherein the stool comprises a bucket with a seat;

wherein the bucket is in an up-right position and has a removable seat that rests upon a top-opening of the bucket;

wherein the bucket rests upon the base and of which is located within the rotating storage container.

3. The multi-function mobile stool as described in claim 2 wherein the seat is attached to the bucket by a lanyard.

4. The multi-function mobile stool as described in claim 3 wherein the bucket has a handle.

5. The multi-function mobile stool as described in claim 2 wherein the seat is made of a material comprising a metal, a wood, a rubber, a plastic, a cotton fabric, or a durable base with a soft foam along the top surface.

6. The multi-function mobile stool as described in claim 1 wherein the rotating means comprises a roller track that is integrated into the top surface of the base, a corresponding roller track integrated into the bottom surface of the rotating storage container, and a plurality of ball bearings.

7. The multi-function mobile stool as described in claim 5 wherein additional roller tracks are integrated into the respective surfaces of the rotating storage container and the base.

8. The multi-function mobile stool as described in claim 1 wherein a caster wheel has a wheel lock.

9. The multi-function mobile stool as described in claim 1 wherein a plurality of caster wheels each have a wheel lock.

10. The multi-function mobile stool as described in claim 1 wherein the stool, base, and rotating storage compartment are made of a material comprising a metal, wood, or plastic.

11. The multi-function mobile stool as described in claim 1 wherein the storage compartments of the rotating storage compartment have a sealable enclosure.

* * * * *